US008624827B2

(12) United States Patent
Uehara

(10) Patent No.: US 8,624,827 B2
(45) Date of Patent: Jan. 7, 2014

(54) FIELD SEQUENTIAL DISPLAY DEVICE HAVING LONGER BLACK INSERTION PERIOD AND A PLURALITY OF DISPLAY AREAS

(75) Inventor: Kazuhiro Uehara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 370 days.

(21) Appl. No.: 13/064,054

(22) Filed: Mar. 3, 2011

(65) Prior Publication Data

US 2012/0223973 A1 Sep. 6, 2012

(51) Int. Cl.
*G09G 3/36* (2006.01)

(52) U.S. Cl.
USPC ..... 345/102; 345/690

(58) Field of Classification Search
USPC ..... 345/690–693, 58.87–102; 362/97.1–97.4
See application file for complete search history.

(56) References Cited

U.S. PATENT DOCUMENTS

2007/0279374 A1* 12/2007 Kimura et al. ..... 345/102
2009/0122087 A1* 5/2009 Maruyama et al. ..... 345/690
2010/0007599 A1* 1/2010 Kerofsky ..... 345/102

FOREIGN PATENT DOCUMENTS

JP 2006220685 A 8/2006

* cited by examiner

*Primary Examiner* — Liliana Cerullo
(74) *Attorney, Agent, or Firm* — Harness, Dickey & Pierce, P.L.C.

(57) ABSTRACT

A plurality of display areas are provided in a liquid crystal panel (display portion) and a plurality of illumination areas respectively allowing light from light-emitting diodes (light sources) to be incident upon the plurality of display areas are set in a backlight device (backlight portion). Further, light-emitting diodes of RGB (a plurality of colors) are provided per illumination area. In the light-emitting diodes of RGB, a reference point of start of lighting of the light-emitting diode to be switched on lastly in a frame period is set so as to coincide with a beginning point of a lighting period of the light-emitting diode, and a reference point of start of lighting of the light-emitting diode to be switched on firstly in the frame period is set so as to coincide with an end point of the lighting period of the light-emitting diode.

6 Claims, 8 Drawing Sheets

2

| | | | | | | | | | |
|---|---|---|---|---|---|---|---|---|---|
| 1-1 (1) | 1-2 (2) | 1-3 (3) | 1-4 (4) | 1-5 (5) | 1-6 (6) | 1-7 (7) | 1-8 (8) | 1-9 (9) | 1-10 (10) |
| 2-1 (11) | 2-2 (12) | 2-3 (13) | 2-4 (14) | 2-5 (15) | 2-6 (16) | 2-7 (17) | 2-8 (18) | 2-9 (19) | 2-10 (20) |
| 3-1 (21) | 3-2 (22) | 3-3 (23) | 3-4 (24) | 3-5 (25) | 3-6 (26) | 3-7 (27) | 3-8 (28) | 3-9 (29) | 3-10 (30) |
| 4-1 (31) | 4-2 (32) | 4-3 (33) | 4-4 (34) | 4-5 (35) | 4-6 (36) | 4-7 (37) | 4-8 (38) | 4-9 (39) | 4-10 (40) |
| 5-1 (41) | 5-2 (42) | 5-3 (43) | 5-4 (44) | 5-5 (45) | 5-6 (46) | 5-7 (47) | 5-8 (48) | 5-9 (49) | 5-10 (50) |
| 6-1 (51) | 6-2 (52) | 6-3 (53) | 6-4 (54) | 6-5 (55) | 6-6 (56) | 6-7 (57) | 6-8 (58) | 6-9 (59) | 6-10 (60) |
| 7-1 (61) | 7-2 (62) | 7-3 (63) | 7-4 (64) | 7-5 (65) | 7-6 (66) | 7-7 (67) | 7-8 (68) | 7-9 (69) | 7-10 (70) |
| 8-1 (71) | 8-2 (72) | 8-3 (73) | 8-4 (74) | 8-5 (75) | 8-6 (76) | 8-7 (77) | 8-8 (78) | 8-9 (79) | 8-10 (80) |
| 9-1 (81) | 9-2 (82) | 9-3 (83) | 9-4 (84) | 9-5 (85) | 9-6 (86) | 9-7 (87) | 9-8 (88) | 9-9 (89) | 9-10 (90) |
| 10-1 (91) | 10-2 (92) | 10-3 (93) | 10-4 (94) | 10-5 (95) | 10-6 (96) | 10-7 (97) | 10-8 (98) | 10-9 (99) | 10-10 (100) |

FIG. 6

| | | Time base→ | | | | | | | | | | | | | | | | | | | | |
|---|---|---|---|---|---|---|---|---|---|---|---|---|---|---|---|---|---|---|---|---|---|---|
| | Row | 0 | 1 | 2 | 3 | 4 | 5 | 6 | 7 | 8 | 9 | 10 | 11 | 12 | 13 | 14 | 15 | 16 | 17 | 18 | 19 | 20 |
| Upper area | 1 | R | R | G* | G | G | G | G | B* | B | B | B | B | R* | R | R | R | R | G* | G | G | G |
| | 2 | R | R | R | G* | G | G | G | G | B* | B | B | B | B | R* | R | R | R | R | G* | G | G |
| | 3 | R | R | R | R | G* | G | G | G | G | B* | B | B | B | B | R* | R | R | R | R | G* | G |
| | 4 | R* | R | R | R | R | G* | G | G | G | G | B* | B | B | B | B | R* | R | R | R | R | G* |
| | 5 | B | R* | R | R | R | R | G* | G | G | G | G | B* | B | B | B | B | R* | R | R | R | R |
| Lower area | 6 | R | R | G* | G | G | G | G | B* | B | B | B | B | R* | R | R | R | R | G* | G | G | G |
| | 7 | R | R | R | G* | G | G | G | G | B* | B | B | B | B | R* | R | R | R | R | G* | G | G |
| | 8 | R | R | R | R | G* | G | G | G | G | B* | B | B | B | B | R* | R | R | R | R | G* | G |
| | 9 | R* | R | R | R | R | G* | G | G | G | G | B* | B | B | B | B | R* | R | R | R | R | G* |
| | 10 | B | R* | R | R | R | R | G* | G | G | G | G | B* | B | B | B | B | R* | R | R | R | R |

FIG. 7

FIELD SEQUENTIAL DISPLAY DEVICE HAVING LONGER BLACK INSERTION PERIOD AND A PLURALITY OF DISPLAY AREAS

BACKGROUND OF THE INVENTION

1. Field of the Invention

The present invention relates to a display device, and in particular, to a non-light-emitting display device such as a liquid crystal display device.

2. Description of Related Art

Recently, for example, liquid crystal display devices have been used widely in liquid crystal televisions, monitors, and mobile telephones, as flat panel displays having features such as thinness and light weight, compared with conventional Braun tubes. Such a liquid crystal display device includes a backlight device emitting light and a liquid crystal panel displaying a desired image by playing a role of a shutter with respect to light from light sources provided in the backlight device.

Further, in the above-described conventional liquid crystal display device, for example, JP 2006-220685 A has proposed the following: with respect to a liquid crystal panel not provided with color filters, a driving method (so-called field sequential driving) is performed in which LEDs of three colors of RGB are used as light sources and they are caused to blink sequentially, so that an image of red alone, an image of green alone, and an image of blue alone are displayed in order in one frame period. Thus, this conventional liquid crystal display device enables a high pixel density display and low power consumption of the liquid crystal panel.

Specifically, in the above-described conventional liquid crystal display device, as shown in FIG. 9, in any five pixels a, b, c, d and e for example, LEDs of RGB are switched on sequentially in a frame period of information to be displayed on the liquid crystal panel. More specifically, in the conventional liquid crystal display device, the LED of R is switched on between a time T51 and a time T53 in the frame period between the time T51 and a time T52. After that, in the conventional liquid crystal display device, the LED of G is switched on between a time T54 and a time T55, and the LED of B is switched on between a time T56 and a time T57. Further, at this time, in each of the pixels a-e, a source signal (voltage signal) in accordance with information to be displayed is supplied from a source driver (not shown). Thus, each of the pixels a-e is activated in accordance with the supplied source signal and outputs the corresponding color of light toward outside, whereby an image of said color is displayed. Specifically, in FIG. 9, a value indicated by % in each of the pixels a-e refers to a transmittance in the pixel. That is, in the case where the magnitude of the source signal at the time of displaying an information with the maximum luminance value is set as 100%, the value in each of the pixels a-e indicates the magnitude of the source signal to be supplied thereto in accordance with the information to be displayed. For example, in the pixel a, 80% of the source signal is given when the LED of R of is switched on at 100%, whereby the pixel a displays information of red with the luminance value of 80% based on the maximum luminance value. Further, the period between the time T53 and the time T54, the period between the time T55 and the time T56, and the period between the time T57 and the time T52 respectively are set as response times for writing source signals into the liquid crystal.

Further, in the conventional liquid crystal display device, as shown in FIG. 9, since one pixel displays colors of RGB sequentially, the high pixel density display of the liquid crystal panel is achieved. Further, in the conventional liquid crystal display device, since the number of source drivers to be installed is reduced by ⅓ as compared with the liquid crystal panel using color filters, low power consumption is achieved.

In the above-described liquid crystal display device, a technique for improving the moving image performance is required. Particularly, in a high-end product such as a liquid crystal television capable of receiving digital broadcasting or the like, there is a strong demand for realizing the moving image performance of the CRT level. Therefore, for changing the liquid crystal display device that is a hold-type display device into a (pseudo) impulse-driven type, a black insertion to a display screen is required.

However, in the conventional liquid crystal display device as described above, the black insertion is not taken into consideration, which prevents the improvement of the moving image performance.

SUMMARY OF THE INVENTION

With the foregoing in mind, it is an object of the present invention to provide a display device capable of improving the moving image performance.

In order to achieve the above-described object, a display device according to the present invention is a display device including a backlight portion that has light sources and a display portion that is provided with a plurality of pixels and displays information using illumination light from the backlight portion. The display device includes: a plurality of display areas that are provided in the display portion; a plurality of illumination areas that are set in the backlight portion and that respectively allow light from the light sources to be incident upon the plurality of display areas; and a controller that drives and controls the backlight portion and the display portion using an input image signal, wherein the backlight portion is provided, per the illumination area, with light sources of a plurality of colors respectively emitting light of a plurality of colors that are mixable into a white color, the light sources of a plurality of colors are switched on sequentially in a predetermined order in a frame period of information to be displayed on the display portion, and in the light sources of a plurality of colors, a reference point of start of lighting of the light source to be switched on lastly in the frame period is set so as to coincide with a beginning point of a lighting period of the light source, and a reference point of start of lighting of the light source to be switched on firstly in the frame period is set so as to coincide with an end point of the lighting period of the light source.

In the display device configured as described above, the backlight portion is provided, per the illumination area, with light sources of a plurality of colors respectively emitting light of a plurality of colors that are mixable into a white color. Further, the light sources of a plurality of colors are switched on sequentially in a predetermined order in a frame period of information to be displayed on the display portion. Further, in the light sources of a plurality of colors, a reference point of start of lighting of the light source to be switched on lastly in the frame period is set so as to coincide with a beginning point of a lighting period of the light source, and a reference point of start of lighting of the light source to be switched on firstly in the frame period is set so as to coincide with an end point of the lighting period of the light source. Thus, unlike the above-described conventional example, in between adjacent frame periods, a period in which the light sources are not switched on can be extended, whereby a period of black insertion can be set longer. Therefore, it is possible to obtain a display device capable of improving the moving image performance.

Further, preferably, in the above-described display device, the controller includes: a backlight controller that determines luminance values of light that is incident from the plurality of illumination areas to the corresponding display areas using an input image signal, corrects the determined luminance values per the illumination area using luminance values of a surrounding illumination area and drives and controls the backlight portion based on the corrected luminance values; and a display controller that corrects the image signal using the corrected luminance values of each of the plurality of illumination areas and drives and controls the display portion on a pixel basis based on the corrected image signal, and the backlight controller switches on the corresponding light source based on the corrected luminance values of each of the plurality of illumination areas.

In this case, the backlight controller and the display controller respectively drive the backlight portion and the display portion appropriately, whereby high display quality can be obtained easily.

Further, in the above-described display device, the backlight controller includes: an area luminance calculator that obtains, per the illumination area, luminance information of pixels included in the corresponding display area from the input image signal and calculates the corrected luminance values of each of the plurality of illumination areas using the obtained luminance information of pixels; and a driving controller that determines a lighting period of the corresponding light source based on the corrected luminance values of each of the plurality of illumination areas and switches on the light source in accordance with the determined lighting period.

In this case, lighting periods of the light sources of a plurality of colors are determined appropriately in accordance with the input image signal; besides, the period for black insertion is set appropriately in between adjacent frame periods in accordance with the input image signal, whereby the moving image performance can be enhanced reliably.

Further, preferably, in the above-described display device, the display controller includes a display data correction calculator that obtains display data of each of the plurality of pixels from the input image signal and corrects the obtained display data per the pixel using the corrected luminance values of the corresponding illumination area.

In this case, since the display controller drives the display portion on a pixel basis using the display data corrected by the display data correction calculator, each pixel can be driven more appropriately in accordance with the input image signal and illumination light from the backlight portion in the display device, whereby the decrease in the display quality is avoided more reliably.

Further, in the above-described display device, the light sources of a plurality of colors are red, green and blue light sources respectively emitting red light, green light and blue light.

In this case, the luminance values of red light, green light and blue light contained in light to be incident from each illumination area to the corresponding display area can be determined appropriately, whereby it is possible to obtain a display device capable of displaying colors with superior display quality easily.

BRIEF DESCRIPTION OF THE DRAWINGS

FIG. 6 is a view illustrating a specific example of a plurality of illumination areas provided in the backlight device and a plurality of display areas illuminated by light from the illumination areas.

FIG. 7 is a view illustrating an operation of the backlight device and the liquid crystal display device.

FIG. 8 are views illustrating lighting operations of respective light-emitting diodes of RGB shown in FIG. 2.

DETAILED DESCRIPTION OF THE INVENTION

Figure 1:
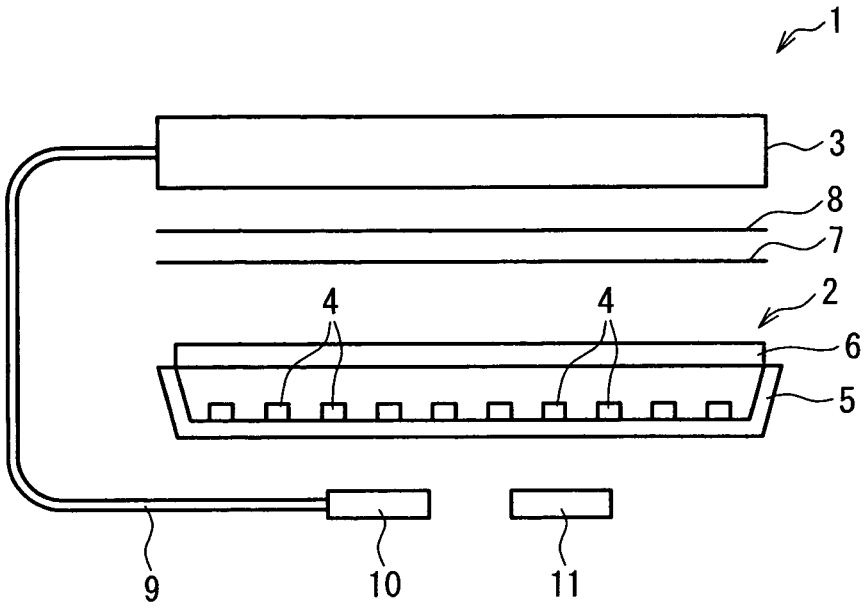
FIG. 1 is a view illustrating a liquid crystal display device according to one embodiment of the present invention.

Hereinafter, a preferred embodiment of a display device of the present invention will be described with reference to drawings. In the following description, the case where the present invention is applied to a transmission-type liquid crystal display device will be described. Further, the dimensions of constituent members in the drawings do not faithfully reflect the actual dimensions of constituent members, dimension ratio of the respective constituent members, etc.

Figure 2:
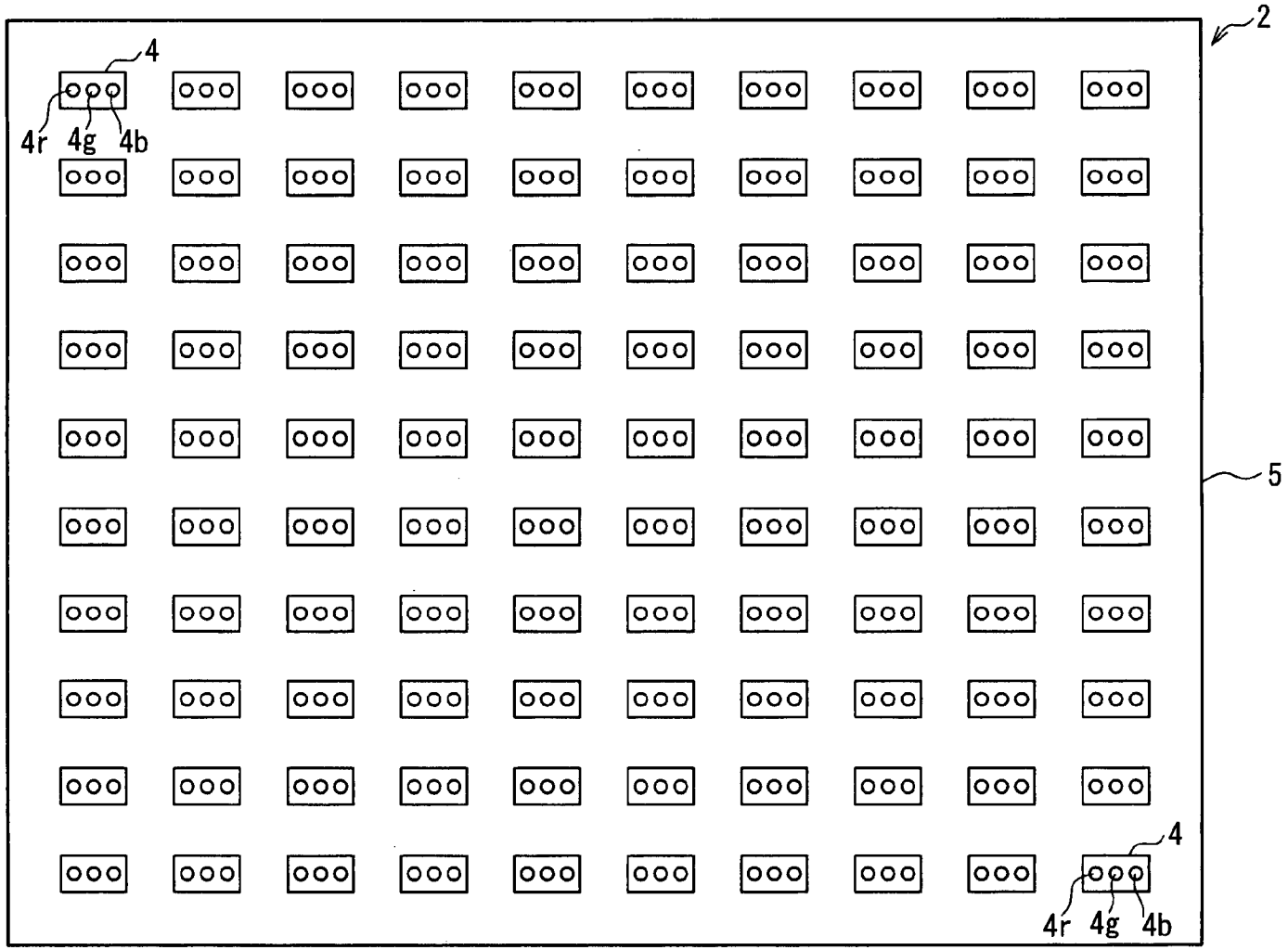
FIG. 2 is a plan view showing a configuration of main portions of a backlight device shown in FIG. 1.

FIG. 1 is a view illustrating a liquid crystal display device according to one embodiment of the present invention, and FIG. 2 is a plan view showing a configuration of main portions of a backlight device shown in FIG. 1. In FIGS. 1 and 2, a liquid crystal display device 1 of the present embodiment includes a backlight device 2 as a backlight portion and a liquid crystal panel 3 as a display portion for displaying information, which is illuminated by light from the backlight device 2. In the present embodiment, the backlight device 2 and the liquid crystal panel 3 are integrated as the transmission-type liquid crystal display device 1.

The backlight device 2 includes a plurality of light-emitting diodes 4 as light sources, a bottomed housing 5 containing the plurality of light-emitting diodes 4, and a diffusion plate 6 disposed on the housing 5 in such a manner as to cover an opening of the housing 5 and diffusing light from the light-emitting diodes 4. Thereby planar illumination light is illuminated from the diffusion plate 6 toward a liquid crystal panel 3 side. Further, in the backlight device 2, as shown in FIG. 2, one hundred light-emitting diodes 4 in total are used that are arranged in ten rows and ten columns so as to be parallel to a transverse direction and a column direction of a display surface of the liquid crystal panel 3, respectively.

Further, as the plurality of light-emitting diodes 4, for example, so-called three-in-one (3-in-1) type light-emitting diodes each including red, green and blue light-emitting diodes 4*r*, 4*g* and 4*b* that respectively emit red (R) light, green (G) light and blue (B) light are used. In the backlight device 2, as will be described later, one hundred illumination areas set for light-emitting diodes 4 are determined. Further, the backlight device 2 is configured so as to allow light from the corresponding light-emitting diodes 4 to be incident upon one hundred display areas that are set on the display surface so as to correspond to these illumination areas. Further, the 3-in-1 type light-emitting diodes 4 are used in each illumination area, i.e., light sources of a plurality of colors that are mixable into a white color are used in each illumination area.

Further, in the liquid crystal display device 1, for example, optical sheets such as a polarization sheet 7 and a prism (collecting) sheet 8 are disposed between the liquid crystal panel 3 and the diffusion plate 6, thereby appropriately increasing the luminance of the illumination light from the backlight device 2 and improving the display performance of the liquid crystal panel 3.

Further, in the liquid crystal display device 1, signal lines (source lines) and control lines (gate lines) (described later) provided in the liquid crystal panel 3 are connected to a drive control circuit 10 via a FPC (Flexible Printed Circuit) 9. Further, in the liquid crystal display device 1, the drive control circuit 10 drives and controls a plurality of pixels on a pixel basis that are provided in the liquid crystal panel 3. Further, as shown in FIG. 1, a lighting drive circuit 11 for switching on the plurality of light-emitting diodes 4 is disposed near the drive control circuit 10. The lighting drive circuit 11 switches on the respective light-emitting diodes 4 by PWM dimming, for example.

Next, a configuration of main portions of the liquid crystal display device 1 of the present embodiment will be described specifically with reference to FIGS. 3-5.

Figure 3:
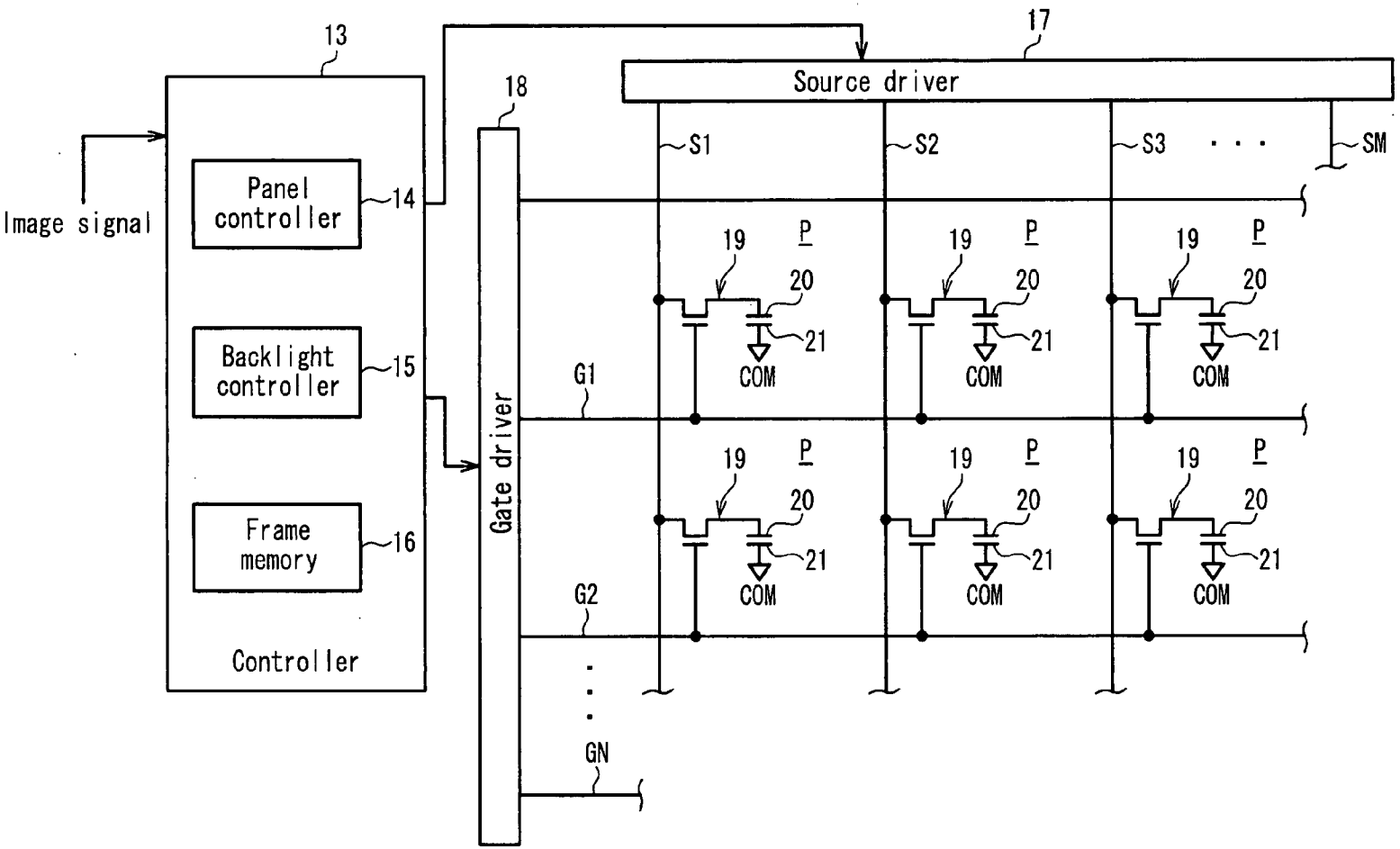
FIG. 3 is a view illustrating a configuration of main portions of the liquid crystal display device shown in FIG. 1.

FIG. 3 is a view illustrating a configuration of main portions of the liquid crystal display device shown in FIG. 1. FIG. 4 is a block diagram showing a configuration example of a panel controller shown in FIG. 3. FIG. 5 is a block diagram showing a configuration example of a backlight controller shown in FIG. 3.

In FIG. 3, an image signal is input to a controller 13 from the outside of the liquid crystal display device 1 via a signal source (not shown) such as a television (receiver) or a personal computer and the like. The controller 13 is provided in the drive control circuit 10 (FIG. 1) so as to practically drive and control the liquid crystal panel 3 using the input image signal. Further, the controller 13 is configured so as to practically drive and control the backlight device 2 using the input image signal.

Specifically, the controller 13 includes a panel controller 14 as a display controller for driving and controlling the liquid crystal panel 3 on a pixel basis using an image signal, a backlight controller 15 for driving and controlling the respective light-emitting diodes 4 in the backlight device 2 using the image signal, and a frame memory 16 capable of storing display data per frame contained in the image signal. In each of the panel controller 14 and the backlight controller 15, for example, ASIC (Application Specific Integrated Circuit) is used, which allows the panel controller 14 and the backlight controller 15 to speedily perform predetermined calculation processing on the display data stored sequentially in the frame memory 16. Further, as described above, in the liquid crystal display device 1 of the present embodiment, since the panel controller 14 and the backlight controller 15 are provided, the panel controller 14 and the backlight controller 15 drive the liquid crystal panel 3 (display portion) and the backlight device 2 (backlight portion), respectively, in an appropriate manner, whereby display with high quality can be achieved easily.

Further, the panel controller 14 outputs instruction signals respectively to a source driver 17 and a gate driver 18. Further, a luminance value of each illumination area is notified from an area luminance calculator (described later) provided in the backlight controller 15 to the panel control portion 14. Thus, the instruction signal to the source driver 17 is output from the panel controller 14 to the source driver 17 after being corrected so as to reflect the notified luminance value of each illumination area (the details will be described later).

The source driver 17 and the gate driver 18 are driving circuits for driving a plurality of pixels P on a pixel basis that are provided in the liquid crystal panel 3. A plurality of signal lines 51 to SM (M is an integer greater than or equal to 2) are connected to the source driver 17 and a plurality of control lines G1 to GN (N is an integer greater than or equal to 2) are connected to the gate driver 18. These signal lines S1 to SM and control lines G1 to GN are arranged in matrix, and the plurality of pixels P are formed in respective areas partitioned in matrix by the signal lines and the control lines. Further, color filters are not provided in the liquid crystal panel 3. Therefore, in the backlight device 2, by sequentially switching on the light-emitting diodes 4*r*, 4*g* and 4*b* of RGB provided in each illumination area, each pixel P functions as red, green, and blue pixels.

Further, a switching element 19 formed of, e.g., a thin film transistor is provided in each pixel P and a gate of the switching element 19 is connected to any one of the control lines G1 to GN. On the other hand, a source of the switching element 19 is connected to any one of the signal lines S1 to SM. Further, a pixel electrode 20 provided in each pixel P is connected to a drain of the switching element 19. Further, in each pixel P, a common electrode 21 is disposed so as to be opposed to the pixel electrode 20, with a liquid crystal layer (not shown) provided in the liquid crystal panel 3 interposed between the common electrode 21 and the pixel electrode 20.

Figure 4:
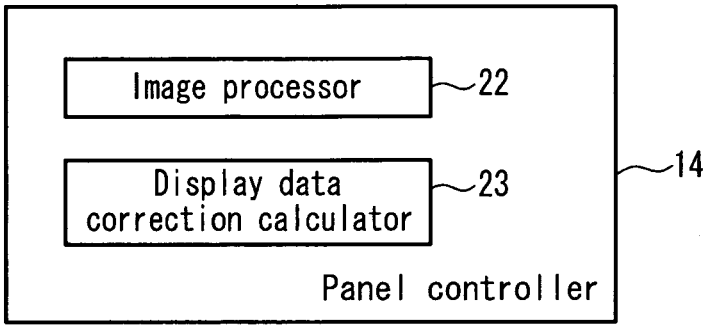
FIG. 4 is a block diagram showing a configuration example of a panel controller shown in FIG. 3.

Further, with reference to FIG. 4, the panel controller 14 includes an image processor 22 and a display data correction calculator 23, and they respectively generate instruction signals to the source driver 17 and the gate driver 18 using the input image signal. Specifically, the image processor 22 generates an instruction signal to the gate driver 18 based on the display data of the image signal stored in the frame memory 16 and outputs the instruction signal to the gate driver 18. On the basis of the instruction signal from the image processor 22, the gate driver 18 sequentially outputs gate signals to the control lines G1 to GN for turning on the gate of the corresponding switching element 19. Further, the image processor 22 generates an instruction signal to the source driver 17 based on the display data and outputs the instruction signal to the display data correction calculator 23.

With respect to the display data correction calculator 23, not only the instruction signal from the image processor 22 to the source driver 17 but also the luminance value of each illumination area from the area luminance calculator is input. These luminance values of the respective illumination areas have been corrected by using the luminance values of the surrounding illumination areas and the influence of crosstalk of light from the surrounding illumination areas is taken into consideration. As described later, the display data correction calculator 23 corrects the instruction signal to the source driver 17 on a pixel basis by using the luminance value of each illumination area so as to generate a new instruction signal and outputs the new instruction signal to the source driver 17. Thus, the source driver 17 appropriately outputs voltage signals (gradation voltage) that specify the luminance (gradation) of information to be displayed on the display surface with respect to the signal lines S1 to SM, based on the instruction signal from the display data correction calculator 23.

Note here that, other than the above-described configuration, the display data correction calculator 23 may directly obtain the display data of the image signal from the frame memory 16 and correct the obtained display data per pixel P by using the corrected luminance value of the corresponding illumination area.

Figure 5:
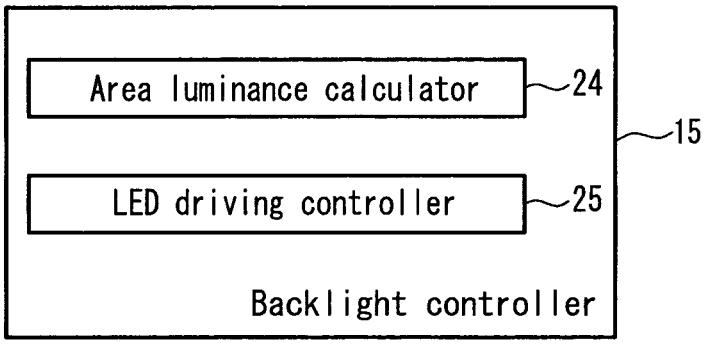
FIG. 5 is a block diagram showing a configuration example of a backlight controller shown in FIG. 3.

With reference to FIG. 5, the backlight controller 15 includes an area luminance calculator 24 and a LED driving controller 25. Further, as described later, the backlight controller 15 groups the light-emitting diodes 4 composed of 10 rows and 10 columns shown in FIG. 2 into an upper area from the first to fifth rows and a lower area from the sixth to tenth rows, and switches on the light-emitting diodes 4 on a row basis in the upper and lower areas.

The area luminance calculator 24 obtains, per illumination area, luminance information of the pixels P included in the corresponding display area from the input image signal. Further, by using the obtained luminance information of the pixels P, the area luminance calculator 24 calculates red, green and blue luminance values in each illumination area (luminance calculation processing) (the detail will be described later). Further, by performing after-mentioned area crosstalk correction processing on the luminance values of the respective colors obtained by luminance calculation processing, the area luminance calculator 24 determines corrected luminance values of the respective colors that take into consideration the influence of crosstalk of light from the surrounding illumination areas. Then, the area luminance calculator 24 outputs the corrected red, green and blue luminance values of each illumination area to the display data correction calculator 23 and the LED driving controller 25.

Here, also with reference to FIG. 6, the illumination area and the display area provided on the backlight device 2 side and the liquid crystal panel 3 side, respectively, and the luminance calculation processing and the area crosstalk correction processing in the area luminance calculator 24 will be described specifically.

FIG. 6 is a view illustrating a specific example of a plurality of illumination areas provided in the backlight device and a plurality of display areas illuminated by light from the illumination areas.

First, a plurality of illumination areas and a plurality of display areas will be described. As shown in FIG. 6, in the backlight device 2, one hundred illumination areas 1-1, 1-2, . . . , 10-9,10-10 in total are provided on a light-emitting surface (a surface of the diffusion plate 6 on the liquid crystal panel 3 side (FIG. 1)) emitting planar illumination light and are arranged so as to be opposed to the liquid crystal panel 3 side. These illumination areas 1-1,1-2, . . . , 10-9,10-10 are set for one hundred light-emitting diodes 4 in total composed of ten rows and ten columns shown in FIG. 2. Each illumination area is positioned at a region directly above one light-emitting diode 4.

In FIG. 6, in order to show illumination areas 1-1, 1-2, . . . , 10-9,10-10 clearly, the illumination areas are partitioned with vertical lines and horizontal lines. However, the illumination areas 1-1,1-2, . . . , 10-9,10-10 actually are not partitioned from each other with boundary lines provided on the light-emitting surface or partition members arranged inside the housing 5. Other than this explanation, for example, the inside of the housing 5 may be partitioned in accordance with the illumination areas using the partition members.

Further, the illumination areas 1-1,1-2, . . . , 10-9,10-10 are configured so that light of the light-emitting diodes 4 is incident upon one hundred display areas (1), (2), . . . , (99), (100), respectively, that are provided on the display surface of the liquid crystal panel 3. Each of the display areas (1), (2), . . . , (99), (100) includes a plurality of pixels P. Specifically, in the liquid crystal panel 3, if 1920×1080 pixels P are provided in the transverse×column directions, the respective display areas (1), (2), . . ., (99), (100) include 192×108 pixels P. In the liquid crystal display device 1, the illumination areas 1-1, 1-2, . . . , 10-9,10-10 and the display areas (1), (2), . . . , (99), (100) are set to have a one-to-one relationship as described above, and an area active backlight in which one illumination area appropriately illuminates one display area with illumination light in accordance with information to be displayed is configured.

Further, in the area active backlight, in each of the illumination areas 1-1, 1-2, . . . , 10-9,10-10, color light of RGB from the light-emitting diodes 4*r*, 4*g* and 4*b* contained in the corresponding light-emitting diodes 4 are output independently from one another to the liquid crystal panel 3 side. Thus, in the liquid crystal display device 1, color light of RGB is appropriately incident from the corresponding illumination areas 1-1,1-2, . . . , 10-9,10-10 to the display areas (1), (2), . . . , (99), (100) in accordance with information to be displayed, whereby the color reproducibility of the respective colors of RGB can be improved easily.

Next, the luminance calculation processing and the area crosstalk correction processing in the area luminance calculator 24 will be described. In the following description, a case where the luminance value of the illumination area 2-8, which is located at a center of nine illumination areas 1-7, 1-8, 1-9, 2-7, 2-8, 2-9, 3-7, 3-8, 3-9, is obtained will be described exemplarily.

The area luminance calculator 24 performs the luminance calculation processing on the image signal of each of the nine display areas (7), (8), (9), (17), (18), (19), (27), (28), (29) corresponding respectively to the illumination areas 1-7, 1-8, 1-9, 2-7, 2-8, 2-9, 3-7, 3-8, 3-9, thereby obtaining red, blue and green luminance values in the corresponding illumination areas 1-7, 1-8, 1-9, 2-7, 2-8, 2-9, 3-7, 3-8, 3-9.

Specifically, the area luminance calculator 24 obtains luminance information of a plurality of pixels P (for example, 192×108 pixels P) included in the display area (7) from the frame memory 16. Then, by performing the luminance calculation processing on the obtained luminance information, the area luminance calculator 24 extracts, for example, data of the maximum luminance values of red, blue and green, which then are set as red, blue and green luminance values in the illumination area 1-7 corresponding to the display area (7), respectively. That is, by the luminance calculation processing of the area luminance calculator 24, a luminance value of the pixel P among the plurality of pixels P included in the display area (7) that should be displayed in red with a highest luminance value is selected as a red luminance value in the illumination area 1-7.

Further, in the luminance calculation processing, filtering processing for noise elimination is performed, whereby an adverse effect of noise can be eliminated reliably. Specifically, in the area luminance calculator 24, even when there is a pixel P having an abnormally high luminance value as compared with the surrounding pixels P due to the noise contamination, it is possible to avoid an extraction of such a luminance value as a maximum luminance value.

Similarly, a luminance value of the pixel P among the plurality of pixels P included in the display area (7) that should be displayed in green with a highest luminance value is selected as a green luminance value in the illumination area 1-7. Further, a luminance value of the pixel P among the plurality of pixels P included in the display area (7) that should be displayed in blue with a highest luminance value is selected as a blue luminance value in the illumination area 1-7. Then, the area luminance calculator 24 sets the selected red, blue and green luminance values as the luminance values in the illumination area 1-7.

Further, the area luminance calculator 24 obtains the red, blue and green luminance values in the illumination areas 1-8, 1-9, 2-7, 2-8, 2-9, 3-7, 3-8, 3-9 in a similar manner. Then, the area luminance calculator 24 performs the area crosstalk correction processing on the red, blue and green luminance values of the illumination area 2-8 using the luminance values of the surrounding illumination areas 1-7, 1-8, 1-9, 2-7, 2-9, 3-7, 3-8, 3-9.

In the area crosstalk correction processing, the area luminance calculator 24 corrects the obtained luminance values using correction coefficients stored in a memory (not shown), thereby calculating corrected red, blue and green luminance values of each illumination area.

Specifically, in the illumination area 2-8 for example, the luminance of each color of red, blue and green light is increased by light from the surrounding illumination areas 1-7, 1-8, 1-9, 2-7, 2-9, 3-7, 3-8, 3-9. Therefore, based on test results using an actual product or simulation results, a correction coefficient for each color of red, blue and green is obtained beforehand for compensating the increased amount of luminance and is held in the memory. Then, by using the luminance value of each color of the illumination area 2-8 obtained by the luminance calculation processing and the correction coefficient held in the memory, the area luminance calculator 24 calculates a corrected luminance value of each color of the illumination area 2-8. After that, the area luminance calculator 24 outputs the corrected luminance value of each color of the calculated illumination area to the display data correction calculator 23 and the LED driving controller 25.

Further, since the correction coefficient is determined based on the test results using an actual product, simulation results or the like, the internal structure of the liquid crystal panel 3 and the luminance change by optical sheets such as the polarization sheet 7 and the prism sheet 8 are taken into consideration. Thus, the influence of crosstalk in the liquid crystal display device 1 is eliminated more reliably, and the display quality can be improved more easily.

Returning to FIG. 5, the LED driving controller 25 switches on light sources. Based on the corrected luminance values of the plurality of illumination areas output from the area luminance calculator 24, the LED driving controller 25 determines lighting periods of the corresponding light-emitting diodes 4*r*, 4*g* and 4*b* and switches on the light-emitting diodes 4*r*, 4*g* and 4*b* by the PWM dimming in accordance with the determined lighting periods. Specifically, the LED driving controller 25 determines an ON/OFF duty by the PWM dimming in accordance with the luminance values set by the area luminance calculator 24 and outputs, to the lighting drive circuit 11 (FIG. 1), a signal that instructs the determined ON/OFF duty as an instruction signal.

Further, as described later, in each illumination area, the LED driving controller 25 sets a reference point of the start of lighting of the light-emitting diode 4*b* to be switched on lastly in the frame period among the light-emitting diodes 4*r*, 4*g* and 4*b* of RGB, so as to coincide with the beginning point of the lighting period of the light-emitting diode 4*b*. Further, the LED driving controller 25 sets a reference point of the start of lighting of the light-emitting diode 4*r* to be switched on firstly in the frame period so as to coincide with the end point of the lighting period of the light-emitting diode 4*r*.

On the other hand, upon receiving the red, green and blue luminance values of the illumination areas 1-1,1-2, . . . , 10-9,10-10 from the area luminance calculator 24, the display data correction calculator 23 corrects instruction signals to the source driver 17 input from the image processor 22 by using these luminance values and outputs the corrected signals as new instruction signals to the source driver 17. Specifically, the display data correction calculator 23 corrects gradation voltages for red, green and blue pixels, which have been set by the image processor 22 in accordance with the image signals, based on the luminance value of the corresponding color from the area luminance calculator 24, and sets the corrected gradation voltages as new gradation voltages. Then, the display data correction calculator 23 generates instruction signals that instruct the new gradation voltages for red, green and blue pixels and outputs them to the source driver 17.

As a result, in the liquid crystal panel 3, the transmittance of the illumination light from the illumination areas 1-1, 1-2, . . . , 10-9,10-10 corresponding to the backlight device 2 is changed for the red, green, and blue pixels in accordance with the new gradation voltages from the display data correction calculator 23. Thus, in the liquid crystal display device 1 of the present embodiment, the panel controller 14 corrects image signals using the corrected luminance values of the plurality of illumination areas 1-1,1-2, . . . , 10-9,10-10 and the liquid crystal panel 3 is driven and controlled on a pixel basis based on the corrected image signals. In this way, in the liquid crystal display device 1 of the present embodiment, each pixel P can be driven more appropriately in accordance with the input image signals and illumination light from the backlight device 2, whereby the decrease in the display quality is avoided more reliably.

Hereinafter, an operation of the liquid crystal display device 1 of the present embodiment will be described specifically with reference to FIGS. 7 and 8. In the following description, for the sake of simplicity, the lighting operation of the light-emitting diodes 4*r*, 4*g* and 4*b* of RGB in the illumination areas will be described mainly.

Figure 8A:
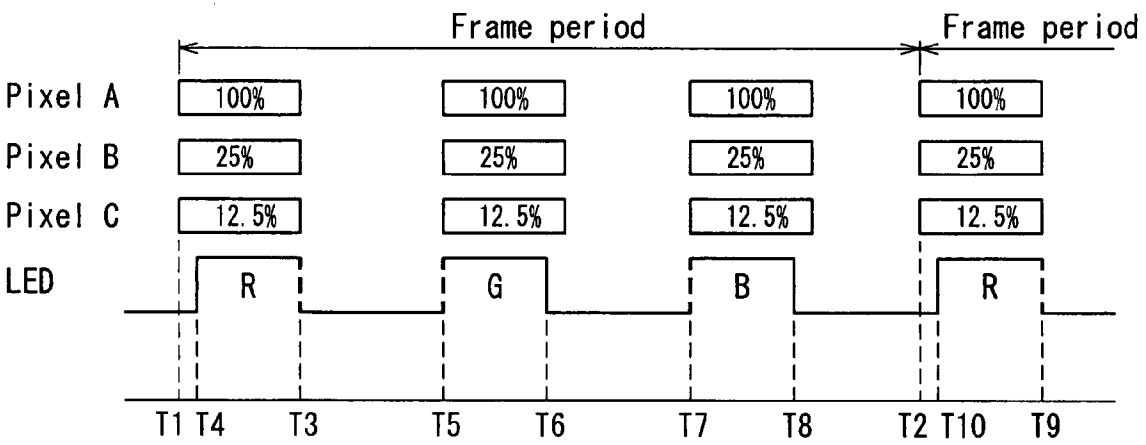
FIG. 8A is a view illustrating an operation example in any pixels A-C.
Figure 8B:
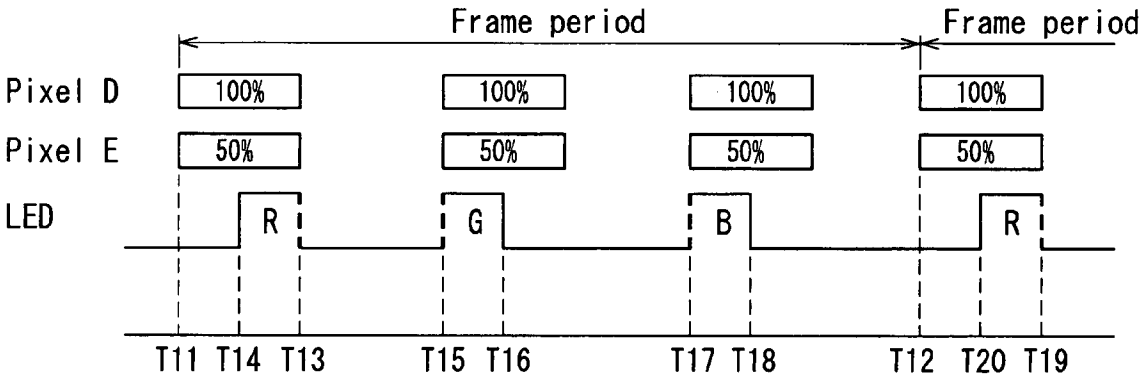
FIG. 8B is a view illustrating an operation example in any pixels D-E.
Figure 9:
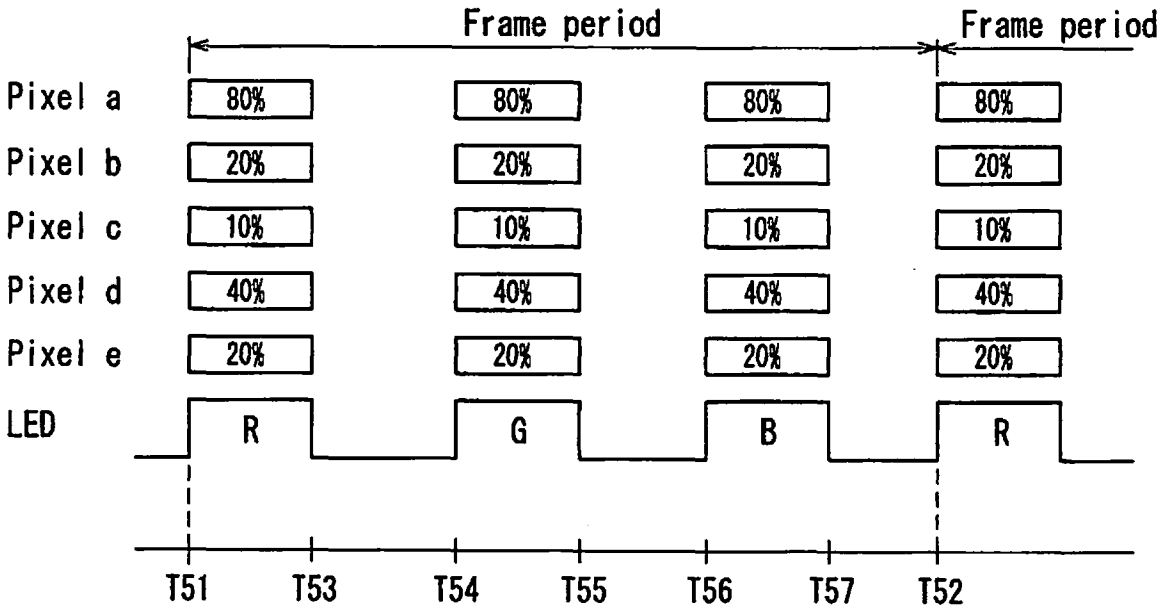
FIG. 9 Conventional Art
FIG. 9 is a view illustrating lighting operations of respective light-emitting diodes of RGB included in a conventional liquid crystal display device.

FIG. 7 is a view illustrating an operation of the above-described backlight device and the liquid crystal display device. FIG. 8 are views illustrating lighting operations of the respective light-emitting diodes of RGB shown in FIG. 2. FIG. 8A is a view illustrating an operation example in any pixels A-C, and FIG. 8B is a view illustrating an operation example in any pixels D-E. Note here that the light-emitting diode 4 group shown in FIG. 7 is composed of ten rows, each row including ten light-emitting diodes 4 arranged parallel to the transverse direction of the display surface of the liquid crystal panel 3. These ten rows are numbered sequentially from the upper side to the lower side of the display surface.

In FIG. 7, characters R,G and B refer to the light-emitting diodes 4*r*, 4*g* and 4*b* of RGB, respectively. Further, in FIG. 7, a period shown by a box with hatching indicates a lighting period in which any of the light-emitting diodes 4*r*, 4*g* and 4*b* shown in the box is switched on. Further, a thick dashed line in FIG. 7 indicates a reference point of the start of lighting in the lighting period. That is, when the LED driving controller 25 determines the length of an ON time (i.e., lighting period) by the PWM dimming in accordance with the luminance value set by the area luminance calculator 24, a start time of the lighting period is indicated by the thick dashed line. Note here that the lighting period shown by hatching indicates a period in the case where the ON time in the ON/OFF duty is 100% by the PWM dimming. The lighting period from the start time will be changed in accordance with the ON time.

Further, as described above, in the light-emitting diode 4 group composed of the upper area from the first to fifth rows and the lower area from the sixth to tenth rows, the LED driving controller 25 switches on the light-emitting diodes 4*r*, 4*g* and 4*b* on a row basis. Specifically, in a period of a time base of "0" for example, the LED driving controller 25 simultaneously switches on all the light-emitting diodes 4*r* in the first and the sixth rows. Then, as shown by hatching in FIG. 7, the LED driving controller 25 simultaneously switches on all the light-emitting diodes 4*r* in the second and the seventh rows. In a similar manner, sequentially, the LED driving controller 25 simultaneously switches on all the light-emitting diodes 4*r* in the third and the eighth rows, all the light-emitting diodes 4*r* in the fourth and the ninth rows, and then all the light-emitting diodes 4*r* in the fifth and the tenth rows.

Further, in FIG. 7, a period indicated by a box with * and a period indicated by a box without hatching respectively refer to a source signal (data) writing period and a liquid crystal response period with respect to a pixel to be displayed by light from any of the light-emitting diodes 4*r*, 4*g* and 4*b* shown in the box. Specifically, in the period of a time base "2" to "4" for example, a source signal is output to a pixel corresponding to the light-emitting diode 4*g* in the first row to be switched on in the period of a time base "5" to "6", which is set as the liquid crystal response period in the pixel. Further, in the source signal writing period and the liquid crystal response period, all the light-emitting diodes 4*r*, 4*g* and 4*b* in the corresponding rows are switched off (non-lighting period).

Further, as shown in FIG. 8A, in any pixels A, B and C, the light-emitting diodes 4*r*, 4*g* and 4*b* of RGB are switched on sequentially in a frame period T1-T2 of the information displayed on the liquid crystal panel 3. At this time, it is assumed that the LED driving controller 25 sets the lighting period (ON time) of each of the light-emitting diodes 4*r*, 4*g* and 4*b* as, e.g., 80% on the basis of the corrected luminance value of each color from the area luminance calculator 24. In this case, in the light-emitting diode 4*r* to be switched on firstly in the frame period T1-T2, a reference point of the start of lighting is set so as to coincide with a time T3, which is an end point of the lighting period of the light-emitting diode 4*r*. Then, the LED driving controller 25 obtains a time T4 that corresponds to the above-described 80% of time from the time T3 and sets the time T4 as the beginning point of the lighting period, thereby switching on the light-emitting diode 4*r* between the time T4 and the time T3.

Further, in the light-emitting diode 4*g*, a reference point of the start of lighting is set so as to coincide with a time T5, which is a beginning point of the lighting period of the light-emitting diode 4*g*. Then, the LED driving controller 25 obtains a time T6 that corresponds to the above-described 80% of time from the time T5, thereby switching on the light-emitting diode 4*g* between the time T5 and the time T6.

Further, in the light-emitting diode 4*b* to be switched on lastly in the frame period T1-T2, a reference point of the start of lighting is set so as to coincide with a time T7, which is a beginning point of the lighting period of the light-emitting diode 4*b*. Then, the LED driving controller 25 obtains a time T8 that corresponds to the above-described 80% of time from the time T7, thereby switching on the light-emitting diode 4*b* between the time T7 and the time T8.

After that, in the light-emitting diode 4*r* to be switched on firstly in the next frame period, the LED driving controller 25 sets a reference point of the start of lighting so as to coincide with a time T9, which is an end point of the lighting period of the light-emitting diode 4*r*. Then, the LED driving controller 25 obtains a time T10 that corresponds to the above-described 80% of time from the time T9 thus set and uses the time T10 as the beginning point of the lighting period, thereby switching on the light-emitting diode 4*r* between the time T10 and the time T9. Thus, in between adjacent frame periods, it is possible to perform a black insertion between the time T8 and the time T10 as a non-lighting period of the light-emitting diodes 4.

Further, in the pixels A, B and C, as shown in FIG. 8A as 100%, 25% and 12.5%, respectively, source signals having the magnitude corresponding to these values are supplied, whereby the pixels A-C are activated in accordance with the supplied source signal and output the corresponding color of light toward outside so as to display images with the corresponding color. Further, the luminance values of the pixels A-C are obtained by multiplying the magnitude of the ON time (80%) and the magnitude of the source signals (100%, 25% and 12.5%) together. Specifically, in the pixel C for example, the display is performed by the luminance value of 10% (=0.8×0.125) based on the maximum luminance value.

Further, as shown in FIG. 8B, in pixels D and E, it is assumed that the LED driving controller 25 sets the lighting period (ON time) of each of the light-emitting diodes 4*r*, 4*g* and 4*b* as, e.g., 40% on the basis of the corrected luminance value of each color from the area luminance calculator 24. In this case, in the light-emitting diode 4*r* to be switched on firstly in a frame period T11-T12, a reference point of the start of lighting is set so as to coincide with a time T13, which is an end point of the lighting period of the light-emitting diode 4*r*. Then, the LED driving controller 25 obtains a time T14 that corresponds to the above-described 40% of time from the time T13 and sets the time T14 as the beginning point of the lighting period, thereby switching on the light-emitting diode 4*r* between the time T14 and the time T13.

Further, in the light-emitting diode 4*g*, a reference point of the start of lighting is set so as to coincide with a time T15, which is a beginning point of the lighting period of the light-emitting diode 4*g*. Then, the LED driving controller 25 obtains a time T16 that corresponds to the above-described 40% of time from the time T15, thereby switching on the light-emitting diode 4*g* between the time T15 and the time T16.

Further, in the light-emitting diode 4*b* to be switched on lastly in the frame period T11-T12, a reference point of the start of lighting is set so as to coincide with a time T17, which is a beginning point of the lighting period of the light-emitting diode 4*b*. Then, the LED driving controller 25 obtains a time T18 that corresponds to the above-described 40% of time from the time T17, thereby switching on the light-emitting diode 4*b* between the time T17 and the time T18.

After that, in the light-emitting diode 4*r* to be switched on firstly in the next frame period, the LED driving controller 25 sets a reference point of the start of lighting so as to coincide with a time T19, which is an end point of the lighting period of the light-emitting diode 4*r*. Then, the LED driving controller 25 obtains a time T20 that corresponds to the above-described 40% of time from the time T19 thus set and uses the time T20 as the beginning point of the lighting period, thereby switching on the light-emitting diode 4*r* between the time T20 and the time T19. Thus, in between adjacent frame periods, it is possible to perform a black insertion between the time T18 and the time T20 as the non-lighting period of the light-emitting diodes 4. Further, as compared with the case shown in FIG. 8A, a period of the black insertion can be set longer in accordance with image signals.

Further, in the pixels D-E, as shown in FIG. 8B as 100% and 50%, respectively, source signals having the magnitude corresponding to these values are supplied, whereby the pixels D-E are activated in accordance with the supplied source signal and output the corresponding color of light toward outside so as to display images with the corresponding color. Further, the luminance values of the pixels D-E are obtained by multiplying the magnitude of the ON time (40%) and the magnitude of the source signals (100% and 50%) together. Specifically, in the pixel E for example, the display is performed by the luminance value of 20% (=0.4×0.5) based on the maximum luminance value.

In the present embodiment configured as described above, in the backlight device (backlight portion) 2, light-emitting diodes 4*r*, 4*g* and 4*b* (light sources) of RGB respectively emitting red light, green light and blue light that are mixable into white light are provided in each of the illumination areas 1-1, 1-2, . . . , 10-9, 10-10.

Further, the light-emitting diodes 4*r*, 4*g* and 4*b* of RGB are switched on sequentially in a predetermined order in the frame period of information to be displayed on the liquid crystal panel (display portion) 3. Further, in the light-emitting diodes 4*r*, 4*g* and 4*b* of RGB, as shown in FIG. 8, the reference point of the start of lighting of the light-emitting diode 4*b* to be switched on lastly in the frame period is set so as to coincide with the beginning point of the lighting period of the light-emitting diode 4*b*, and the reference point of the start of lighting of the light-emitting diode 4*r* to be switched on firstly in the frame period is set so as to coincide with the end point of the lighting period of the light-emitting diode 4*r*. Thus, in the present embodiment, unlike the above-described conventional example, the period in which the light-emitting diodes 4*r*, 4*g* and 4*b* are not switched on can be extended in the period in between the neighboring frame period, whereby the period of black insertion can be set longer. Therefore, in the present embodiment, it is possible to obtain the liquid crystal display device 1 capable of improving the moving image performance.

Further, since the backlight controller 15 of the present embodiment includes the area luminance calculator 24 and the LED driving controller (driving controller) 25, it is possible to appropriately determine the lighting period of each of the light-emitting diodes 4*r*, 4*g* and 4*b* of RGB (the light sources of a plurality of colors) in accordance with the input image signal. Furthermore, the LED driving controller 25 appropriately sets the period of black insertion in between the neighboring frame period in accordance with the input image signal. As a result, in the liquid crystal display device 1 of the present embodiment, it is possible to improve the moving image performance reliably.

The above embodiment is shown merely for an illustrative purpose and is not limiting. The technical range of the present invention is defined by the claims, and all the changes within a range equivalent to the configuration recited in the claims also are included in the technical range of the present invention.

For example, although the case where the present invention is applied to a transmissive liquid crystal display device has been described above, the application of the display device of the present invention is not limited hereto. For example, the display device of the present invention can be applied to a variety of non-luminous display devices displaying information using light of light sources. Specifically, the display device of the present invention can be applied preferably to a semi-transmissive liquid crystal display device or a projection type display device such as a rear projector in which light bulbs are used in the liquid crystal panel.

Further, although the case where a plurality of light sources composed of light-emitting diodes are used in the backlight portion has been described above, the backlight portion of the present invention is not limited hereto as long as the backlight portion includes a plurality of illumination areas that respectively allow light of light sources to be incident upon a plurality of display areas set in the display portion. Specifically, for example, by providing a liquid crystal panel that is identical to the above-described liquid crystal panel (for display) between the light sources and the liquid crystal panel (for display) and setting illumination areas thereon, it can be used as the backlight portion.

However, as in the above-described embodiment, it is preferable not only that a plurality of light sources are provided in accordance with the illumination areas but also that the backlight controller drives the corresponding light sources based on the corrected luminance values of each illumination area, since the plurality of light sources can be driven appropriately and high display quality can be obtained easily. Besides, such a configuration is preferable since a liquid crystal panel for setting the illumination areas is not provided, whereby the display device with simple configuration and low cost can be obtained easily.

Further, although the case where the direct-type backlight device is used as the backlight portion has been described above, an edge-light type backlight device capable of controlling luminance values (light quantities) of each of the plurality of the illumination areas independently from one another can be applied as the backlight portion.

Further, the case of using one set of the 3-in-1 type light-emitting diodes including R, G and B light-emitting diodes in each of the plurality of the illumination areas has been described above. However, the present invention is not limited hereto as long as light sources of a plurality of colors respectively emitting light of a plurality of colors that are mixable into a white color are used. Specifically, so-called four-in-one (4-in-1) type light-emitting diodes including light-emitting diodes of RGBW or two kinds of light-emitting diodes emitting yellow light and blue light may also be used. Further, three light-emitting diodes of RGB composed separately from one another may be used, or four light-emitting diodes of RGGB or the like may also be provided in one illumination area.

However, as in the above embodiment, it is preferable to provide light-emitting diodes (light sources) of RGB in each illumination area, since the luminance values of red, green and blue light contained in light to be incident from each illumination area to the corresponding display area can be determined appropriately. Thus, color purities of these light can be enhanced easily, whereby a display device capable of displaying colors with superior display quality can be obtained easily.

Further, the configuration in which the light-emitting diodes of RGB are switched on sequentially in this order within the frame period has been described above. However, the present invention is not limited hereto as long as, in the light sources of a plurality of colors, a reference point of the start of lighting of the light source to be switched on lastly in the frame period is set so as to coincide with a beginning point of the lighting period of said light source, a reference point of the start of lighting of the light source to be switched on firstly in the frame period is set so as to coincide with an end point of the lighting period of said light source, and the light sources of a plurality of colors are switched on sequentially in a predetermined order in the frame period. Specifically, in the above description, as to the light-emitting diode of G to be switched on secondly in the frame period, as shown in FIG. 8, the reference point of the start of lighting is set so as to coincide with the beginning point of the lighting period of said light-emitting diode of G. However, in the light-emitting diode of G to be switched on secondly, the reference point of the start of lighting may be set so as to coincide with the end point of the lighting period of said light-emitting diode of G.

Further, the case of using the light-emitting diodes of RGB as the light sources of a plurality of colors has been described above. However, the light sources of the present invention are not limited hereto, and discharge tubes such as a cold-cathode tube, a hot-cathode tube or a xenon tube, or other light-emitting elements such as an organic EL (Electronic Luminescence) may be used.

Further, the case of using a monochrome liquid crystal panel not provided with color filters has been described above. However, the display portion of the present invention is not limited hereto. For example, a liquid crystal panel in which color filters of RGB are provided so as to form pixels of RGB may be used as the display portion.

The present invention is useful with respect to a display device capable of improving the moving image performance.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A display device including a backlight portion that has light sources and a display portion that is provided with a plurality of pixels and displays information using illumination light from the backlight portion, comprising:

a plurality of display areas that are provided in the display portion;

a plurality of illumination areas that are set in the backlight portion and that respectively allow light from the light sources to be incident upon the plurality of display areas; and a controller that, drives and controls the backlight portion and the display portion using an input image signal, sets a lighting period indicating the length of each light source on time, and sets a reference point indicating a time from which a lighting of each light source is obtained based on the lighting period;

wherein the backlight portion is provided, the illumination area, with light sources of a plurality of colors respectively emitting light of the plurality of colors that are mixable into a white color, the light sources of the plurality of colors are switched on sequentially in an order in a frame period of information to be displayed on the display portion, and in the light sources of the plurality of colors, the reference point of start of lighting of the light source to be switched on lastly in the frame period is set so as to coincide with a beginning point of the lighting period of the light source to be switched on lastly, and the reference point of start of lighting of the light source to be switched on firstly in the frame period is set so as to coincide with an end point of the lighting period of the light source to be switched on firstly.

2. The display device according to claim 1, wherein the controller includes:

a backlight controller that determines luminance values of light that are incident from the plurality of illumination areas to the corresponding display areas using an input image signal, corrects the determined luminance values per illumination area using luminance values of a surrounding illumination area and drives and controls the backlight portion based on the corrected luminance values; and a display controller that corrects the image signal using the corrected luminance values of each of the plurality of illumination areas and drives and controls the display portion on a pixel basis based on the corrected image signal, and the backlight controller is configured to switches on the corresponding light source based on the corrected luminance values of each of the plurality of illumination areas.

3. The display device according to claim 2, wherein the backlight controller includes:

an area luminance calculator that obtains, per illumination area, luminance information of pixels included in the corresponding display area from the input image signal and calculates the corrected luminance values of each of the plurality of illumination areas using the obtained luminance information of pixels; and a driving controller that determines a lighting period of the corresponding light source based on the corrected luminance values of each of the plurality of illumination areas and switches on the light source in accordance with the determined lighting period.

4. The display device according to claim 2, wherein the display controller includes a display data correction calculator that obtains display data of each of the plurality of pixels from the input image signal and corrects the obtained display data per the pixel using the corrected luminance values of the corresponding illumination area.

5. The display device according to claim 1, wherein the light sources of the plurality of colors are red, green and blue light sources respectively emitting red light, green light and blue light.

6. The display device of claim 1, wherein the plurality of display areas are associated with one of a first display area and a second display area, each of the first and second display areas having n display rows, the controller configured to simultaneously switch on all the plurality of light sources associated with a single color in a kth display row of the first and second display area.

* * * * *